US005900701A

United States Patent [19]

Guhilot et al.

[11] Patent Number: 5,900,701

[45] Date of Patent: May 4, 1999

[54] HIGH FREQUENCY ELECTRONIC BALLAST FOR LIGHTING

[75] Inventors: Hansraj Guhilot, Orissa, India; Shreekanta Nayak, Lanham, Md.

[73] Assignee: Allied Energy Services International, Inc., Lanham, Md.

[21] Appl. No.: 08/651,056

[22] Filed: May 21, 1996

[51] Int. Cl.[6] ..... G05F 1/00

[52] U.S. Cl. ..... 315/307; 315/224; 315/209 R; 315/DIG. 7

[58] Field of Search ..... 315/224, 307, 315/308, 291, 209 R, 205, 207, 246, DIG. 4, DIG. 5, DIG. 7

[56] References Cited

U.S. PATENT DOCUMENTS

| | | | |
|---|---|---|---|
| 3,969,652 | 7/1976 | Herzog | 315/224 |
| 4,042,856 | 8/1977 | Steigerwald | 315/246 |
| 4,220,896 | 9/1980 | Paice | 315/205 |
| 4,701,671 | 10/1987 | Stupp et al. | 315/224 |
| 4,952,849 | 8/1990 | Fellows et al. | 315/307 |
| 5,003,231 | 3/1991 | Perper | 315/291 |
| 5,204,587 | 4/1993 | Mortimer et al. | 315/308 |
| 5,359,274 | 10/1994 | Bandel | 315/207 |
| 5,416,387 | 5/1995 | Cuk et al. | 315/209 R |
| 5,491,386 | 2/1996 | Eriguchi et al. | 315/209 R |

*Primary Examiner*—Robert Pascal
*Assistant Examiner*—Haissa Philogene
*Attorney, Agent, or Firm*—Christina M. Eakman

[57] ABSTRACT

A lighting inverter provides voltage and current to a gas discharge lamp in general and a metal halide lamp in particular with a novel power factor controller. The power factor controller. step down converter having the device stresses of a buck converter, continuous current at its input like a CUK' converter, a high power factor, low input current distortion and high efficiency. The inverter consists of two cyclically rotated CUK' switching cells connected in a half bridge configuration and operated alternately. The inverter is further optimized by using integrated magnetics and a shared energy transfer capacitor. The AC voltage output from the inverter is regulated by varying its frequency. A ballast filter is coupled to the regulated output of the inverter. The ballast filter is formed by a series circuit of a ballast capacitor and a ballast inductor. The lamp is preferably connected across the inductor to minimize the acoustic arc resonance. The values of the capacitor and the inductor are chosen so as to satisfy the firing requirements of the HID lamps. A plurality of lamps are connected by connecting the multiple lamps with the ballast filters to the secondary of the inverter transformer. Almost unity power factor is maintained at the line input as well as the lamp output.

16 Claims, 5 Drawing Sheets

HIGH FREQUENCY ELECTRONIC BALLAST FOR LIGHTING

BACKGROUND OF THE INVENTION

1. Field Of Invention

This invention is directed toward developing a high frequency economical electronic ballast having high power factor, low device stresses, high frequency, low switching losses, and sine wave output for lighting nonlinear loads such as HID lamps, more specifically metal halide lamps and also to provide plurality of the lamp connections for the lighting industry in general.

2. Description Of The Prior Art

The contemporary high frequency electronic ballasts used for lighting purposes use either boost converter or a flyback converter in discontinuous mode for controlling the power factor, and to pre-regulate the DC voltage connected to the inverter. Bandel, in his U.S. Pat. No. 5,359,274, uses boost converter for power factor correction. Mortimer et. al. in their U.S. Pat. No. 5,204, 587 uses flyback PWM converter in discontinuous mode to correct the power factor. Also, use Mapham inverter or Shwartz inverter, or their modifications having half bridge or fall bridge configurations. The prior art Mapham inverter is described by Neville Mapham in *IEEE Transactions on Industry and General Applications,* March/April 1967, IGA-2, No. 2, pages 176–187. Mapham showed an SCR inverter with a good regulation and a sine wave output which provides a frequency dependent output voltage, such as shown in FIG. 1. U.S. Pat. No. 4,220,896 by Derek A. Paice describes a ballast filter which reduces the KVA ratings of the transformer. But in the above mentioned prior art, only the voltage ratings of the transformer are reduced by quality factor times four times the ballast filter. The current ratings of the transformer are increased as it has to take care of the filter capacitor current. Thus, insulation requirements of the transformer are reduced at the cost of increased copper losses in the transformer. From the switch point of view voltage ratings of the switches are reduced, making them economical.

The converters used for power factor correction in the contemporary art had the drawbacks of either forcing high voltage on the inverter switches, or it produced the discontinuous current at the input, thus contributing to EMI/RFI produced. Also the switches used in the prior art inverters have high on losses. This is because the switches have to support the additional current drawn by the capacitor connected in parallel with the transformer primary. For proper operation of the Mapham inverter, a value of the capacitor should be such that it draws at least four times the instantaneous load current.

SUMMARY OF THE INVENTION

Accordingly one of the objects of this invention is to provide a novel lighting inverter having high frequency and high power factor.

Another object of this invention is to provide a novel lighting inverter having the switches of almost one-fourth of the instantaneous current rating of the contemporary art.

Yet another object of this invention is to provide plurality of the lamp connection.

A further object of this invention is to provide a lighting inverter with a power factor controller having continuous current but having DC voltage less or equal to the peak input voltage.

One more object of this invention is to provide feedback from the light to regulate the DC output voltage from the power factor controller.

Yet another object of this invention is to provide start up circuit for negative DC output voltage from power factor controller.

Yet another object of this invention is to provide a lightweight, compact, highly efficient, durable, and economical inverter.

These and other objects of this invention are achieved by employing a cyclically rotated CUK' switching cell in half bridge inverter. The inverter is realized by connecting the cyclically rotated CUK' switching cells so as to generate positive and negative half cycles of the sine wave output. The two CUK' cells use common inductors and a capacitor. (explanation of the cyclically rotated CUK' cell is given in 1996 *International Conference on Power Electronics, Drives and Energy systems for Industrial Growth, Proceedings of IEEE International Conference New Delhi,* January 1996, in the article "High-Quality Rectifier for Resistive Loads" by G. Spiazzil et al.). The power factor controller is also realized using CUK' cell by cyclically rotated it. A new controller for this configuration is described in detail. The inverter output is connected to the ballast filters connected in parallel to the secondary of the inverter transformer. The lamps are connected to the output of the ballast filters. Circuit parameters such as inductor values, capacitor values, ballast inductor values, and ballast capacitor values are adjusted to optimize the operation and arrive at low loss high-frequency. Low current rating inverter is realized which offers high power factor to the input and also to the lamp.

BRIEF DESCRIPTION OF THE DRAWINGS

A more complete appreciation of the invention and many other advantages associated with it becomes better understood by a reference to the following detailed description when considered in connection with the accompanying drawings wherein.

DETAILED DESCRIPTION OF THE PREFERRED EMBODIMENTS

Figure 1:
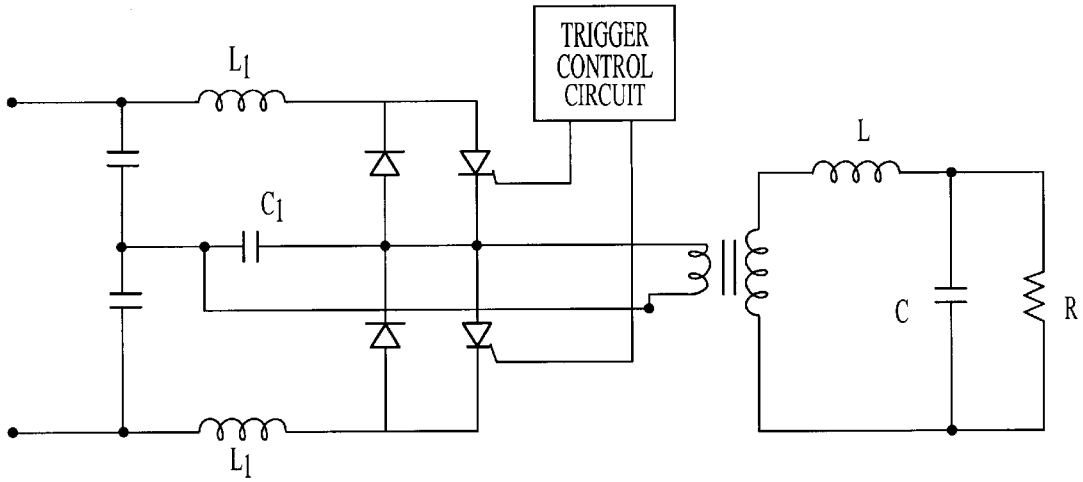
FIG. 1 PRIOR ART
FIG. 1 is circuit of lighting inverters of the of the prior art having different ballast filters.
Figure 2:
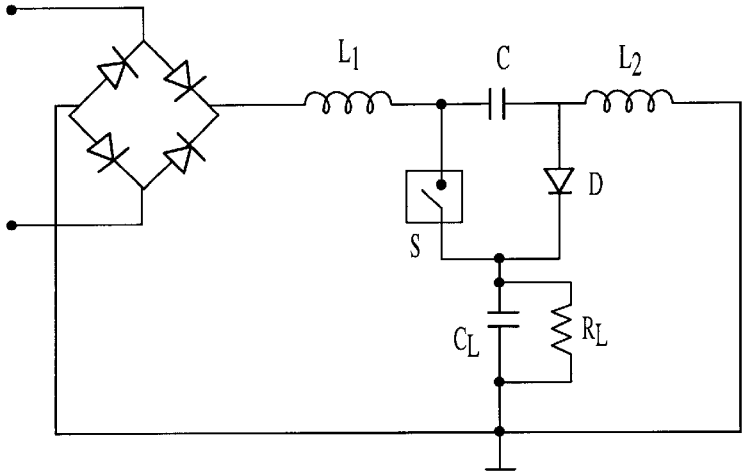
FIG. 2 PRIOR ART
FIG. 2 is a circuit diagram of the prior art high-quality rectifier for resistive loads using cyclically rotated CUK' switching cell but without any control circuitry to actively control power factor and to regulate the DC output voltage.
Figure 3:
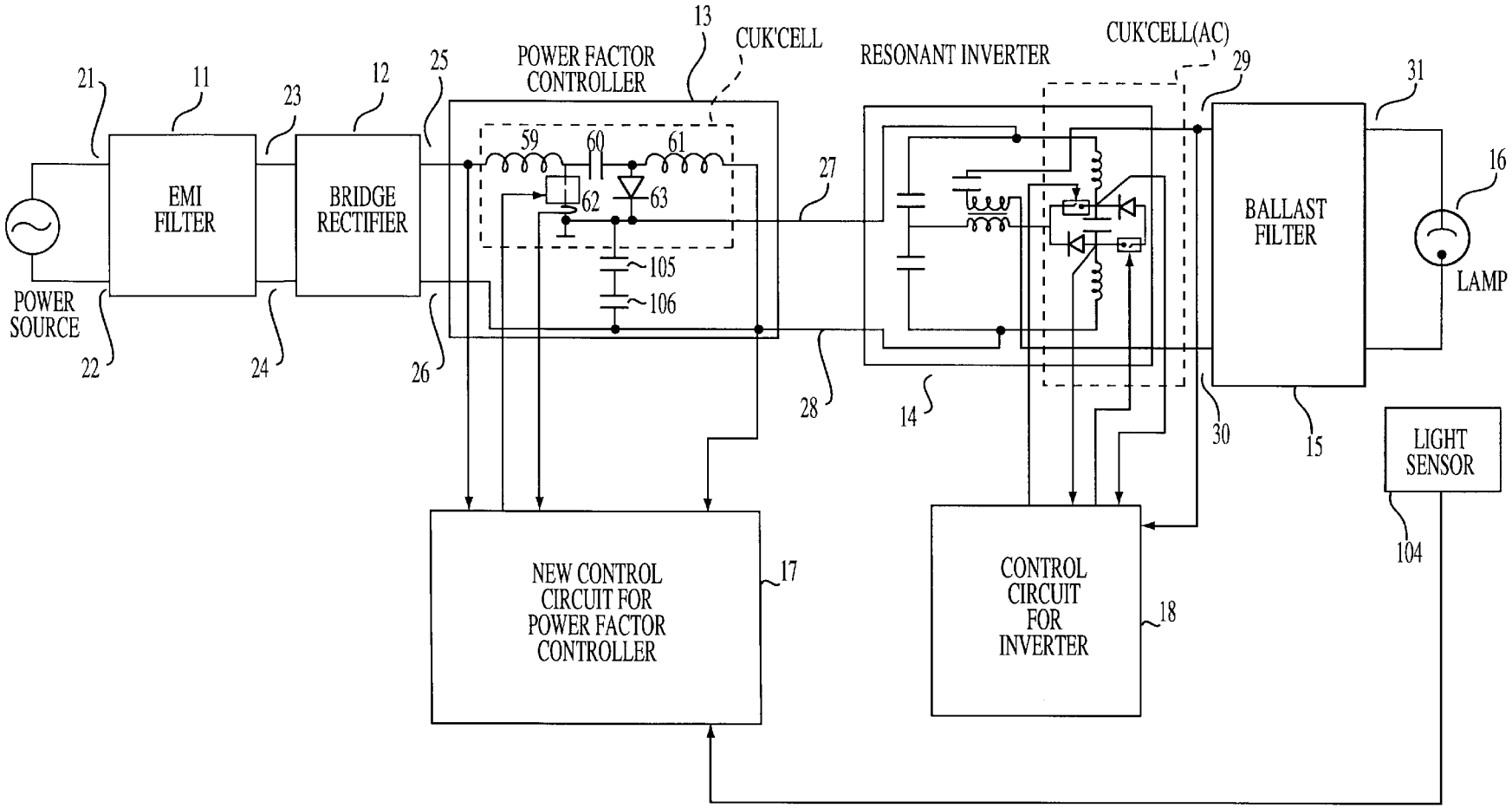
FIG. 3 is a block diagram of the high-efficiency, high power factor, high-frequency electronic ballast of this invention.

Referring now to the drawings, wherein like reference numerals designate identical or corresponding parts throughout the several views and more specifically FIG. 3 thereof the AC, 50 Hz, or 60 Hz supply 10 is connected to the terminals 21 and 22. Terminals 21 and 22 are connected at the input of the EMI/RFI filter. The output of the said filter is connected to the bridge rectifier 12 through terminals 23 and 24. Output of the said rectifier is available at 25, 26. 25 and 26 are connected to the proposed power factor controller and are preregulated by control circuit 17 of the controller 13. This power factor controller controls the power factor of the AC input 10 and more importantly it gives out the DC voltage less a the peak input of 10.

A continuous current at the input terminals 25, 26 CUK' is achieved by cyclically rotating the CUK' cell in the CUK' converter. The converter thus obtained has the advantage of the CUK' converter with the component stresses of buck converter. To have an economical solution for ballasting it is required that we process the power at lower DC voltages, thus reducing the switch voltages ratings. The power output of the power factor controller of the present invention is connected to a new resonant inverter 14 by the terminals 27, 28. The new resonant inverter 14 is again derived by modifying the DC CUK' cell as described in the literature of power electronics. This cell is modified to operate for positive and negative half cycles of the AC high frequency. The high frequency is available at the terminals 29, 30. A ballast filter 15 is connected to the terminals 29, 30. This filter is connected to the lamp load 16 through terminals 31, 32. The resonant inverter is controlled by a control circuit 18 as shown in FIG. 3.

Figure 4A:
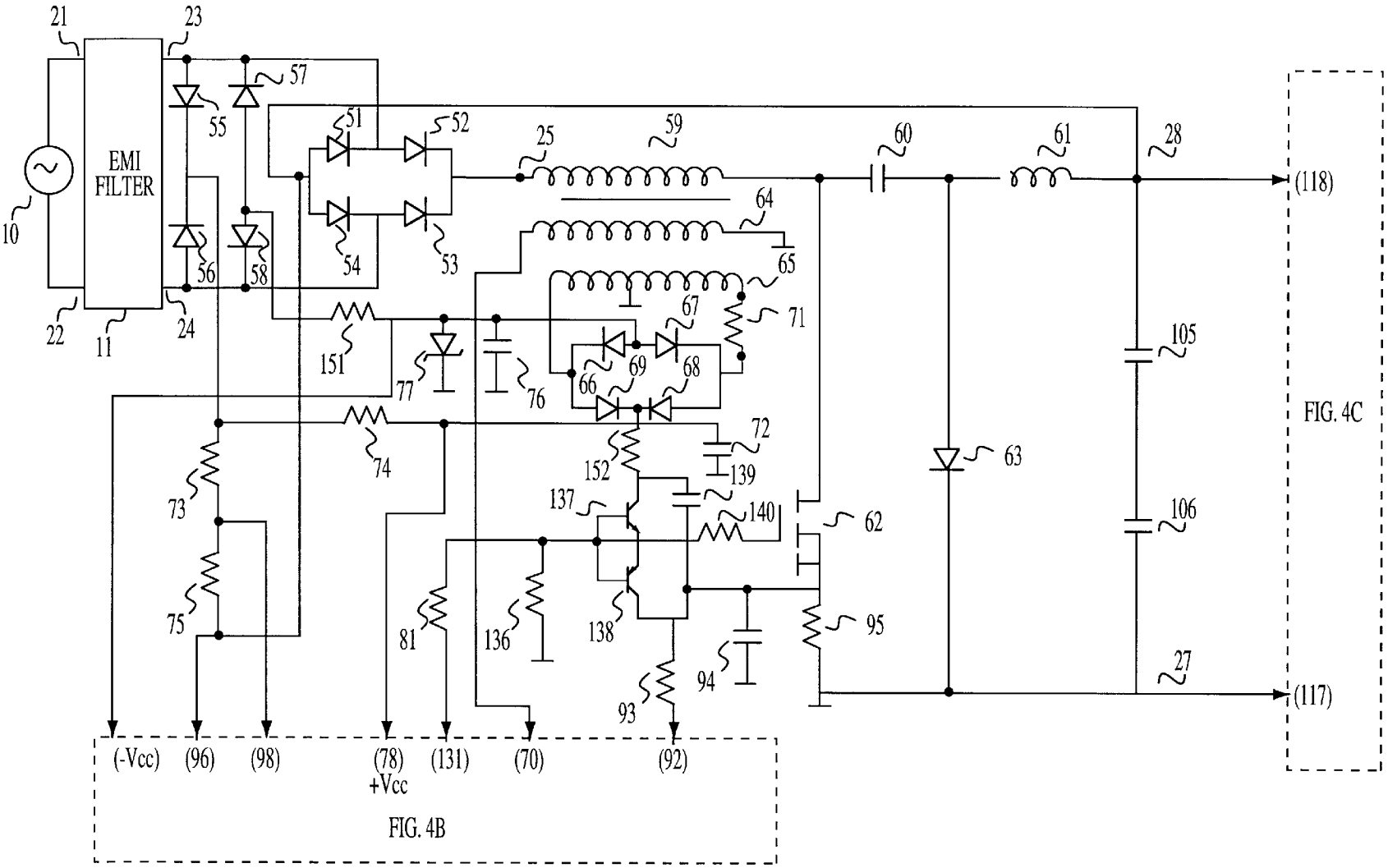
FIG. 4, a composite of FIGS. 4A–4C, is a detailed circuit diagram of this invention showing the new power factor controller, and new inverter with plurality of lamp connections.
Figure 4B:
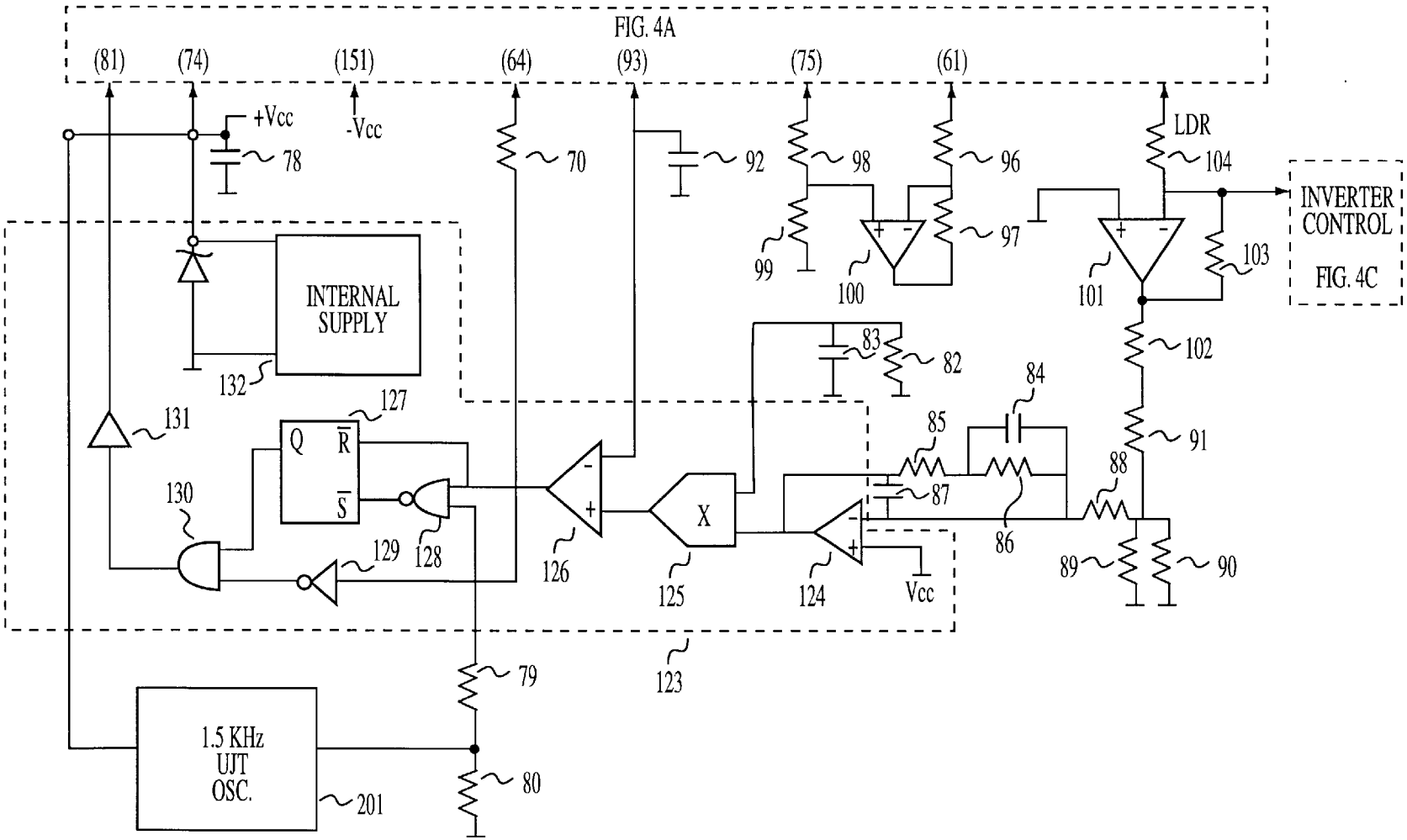
Figure 4C:
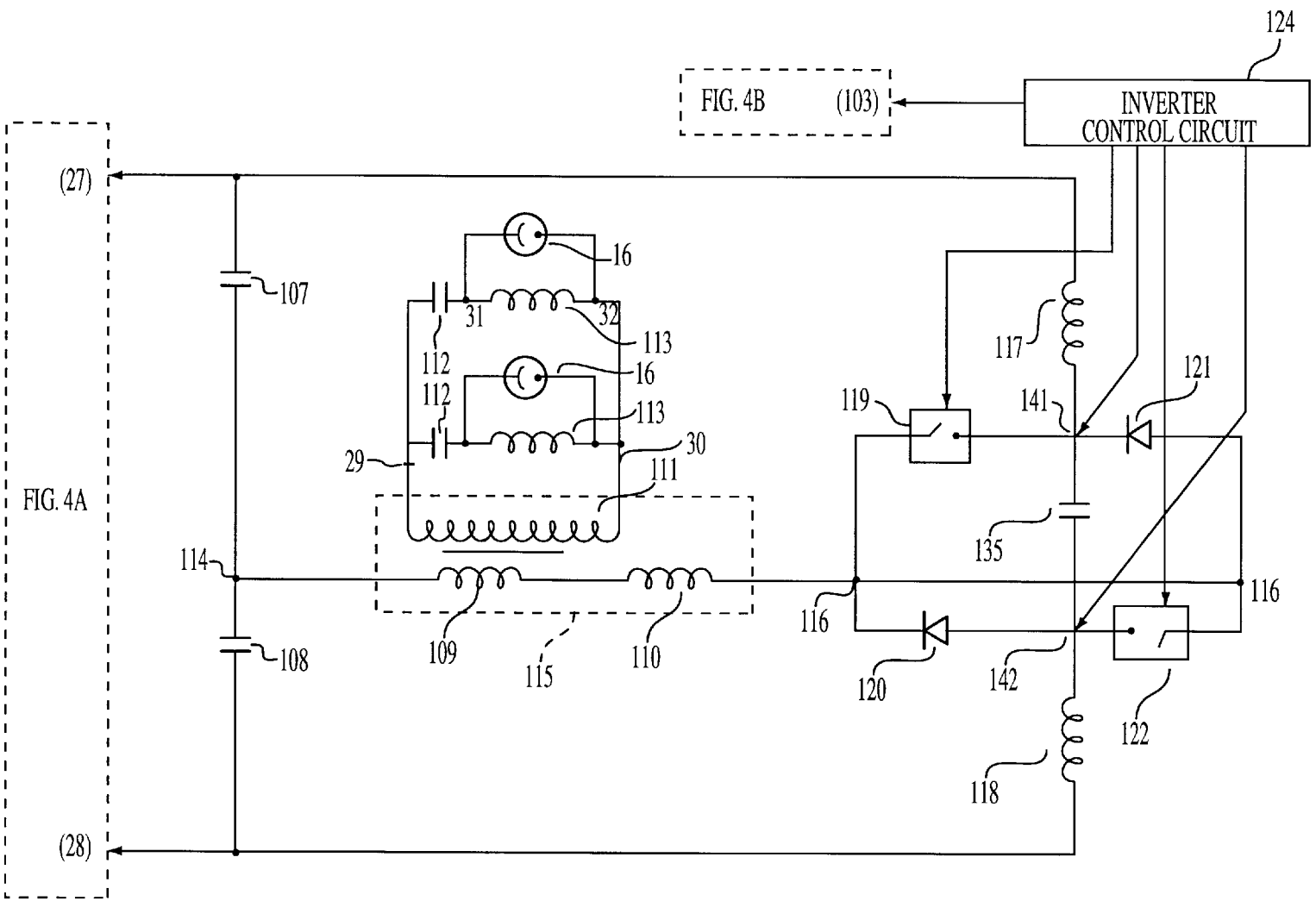

Now referring to FIG. 4, the bridge rectifier consists of diodes 51, 52, 53, 54. Positive output of the bridge rectifier is available at 25. An inductor 59 is connected to terminal 25 and other terminal of this inductor is connected to power switch 62 and first terminal of the energy transfer capacitor 60. Other terminal of the said energy transfer capacitor is connected to anode of diode 63 and first terminal of an inductor 61. Second terminal of the inductor 61 is connected to the other terminal 26, output of the bridge rectifier 12 and the first terminal of filter capacitor 105, 106. Second terminal of the series connected filter capacitor 105 and 106 is connected to the common point of the power factor controller. Cathode of diode 63 is connected to the same common point. Second terminal of the power switch 62 is connected through a current sensing resistor 95 to the said common point. The inductors 59 and 61 are mutually coupled. A controlled DC output from this power factor controller and pre-regulator is available at 27 and 28 with 27 being positive. In this invention a new control circuit for the new power factor controller is shown in FIG. 4, 4A and 4B. The control circuit is built around Siemen's TDA 48148. The circuit around IC's 101 and 100 are new additions to achieve the control of the proposed converter. People well versed in the art of power electronics know how the controller operates. Postive and negative power supplies for the controller are derived from coupled inductor 65, bridge rectifier for the controller consisting of diodes 66, 67, 68, and 69, the filter capacitors 72 and 76. Start-up power to controller is derived from diodes 55, 56, 57, 58 and resistors 74 and 174. A voltage proportional to switch current is derived from resistor 95 and 93 and capacitors 94 and 92. A reference voltage is derived from the differential output of voltages across 25, 26 and 27, 28. A voltage proportional to the rectified sine wave input plus DC output is available from resistors 73, 75. This is connected to non-inverting input of 100 via resistor 98 and 99. DC output is connected to the inverting input of 100 via resistors 96 and 97. IC 101 gives voltage proportional to DC voltage available from power factor controller. In addition to this a feedback from lamp is implemented by light dependent resistor 104 connected to inverted input of the IC 101. The voltage derived from IC 101 and resistors 102, 103, 91, 90, 89 is scaled down and compared with fixed reference voltage inside IC 123. Multiplier 125 gets its input from 100 and 124. Output of the multiplier is compared by comparator 126 with voltage proportional to switch current available from filter 93, 92. The flip-flop 127 is set during no load or zero crossing of the input voltage by and UJT oscillator 201 connected to the junction of potential divider 79, 80. Zero crossing of the inductor current is detected by resistors 70, 79, 80 and the inductor 64 coupled to inductor 59.

Most of the power factor controllers use boost converter or flyback converter. In the present invention a new converter having component stresses like that of a buck converter, continuous current like that of a CUK' converter and output voltage like that of a buck converter is described. The control circuit for the converter is described which includes a new light feedback from the lamp 16. Present converter produces negative output voltage less a the peak input voltage. DC output from the power controller is given by the equation:

$$V_{(27,28)}=[((V_{REF}(R_{102}+R_{91}+R_{90})(R_{104}))/(R_{90})(R1_{103}))]$$

Resistor $R_{104}$ increases when the light output from the lamp decreases. This, in turn, increases the DC voltage $V_{(27,28)}$, thereby increasing the input voltage to the inverter 14. The current ripple is adjusted by adjusting the values and the coupling co-efficient of inductors 59 and 61.

The inverter used in this invention is a resonant inverter. It defaults from its prior art Mapham inverter in the location of the capacitor 135. In Mapham inverter, this capacitor is connected across primary winding of the transformer 115. But this causes increased losses in the switches. To reduce the on losses an inverter as shown in FIG. 4 is used. The inverter consists of series connected capacitors 107 and 108. First terminal of these series connector capacitors is connected to 27, and second terminal of it is connected to 28; to the first terminal of the series connected capacitors is also connected first terminal of an inductor 117. Second terminal of the inductor 117 is connected to 141, between 141 and 142 a capacitor 135 is connected. An inductor 118 is connected between 142 and 28. Inductors 117 and 118 are mutually coupled to minimize the bulk. Inductors 117 and 118, diode 120 and a switch 119, form one CUK' cell operating at resonance and generating positive half of the output waveform. The inductors 117 and 118, diode 121 and switch 122 forms another CUK' cell operating at resonance. To reduce the bulk and make it economical common passive components like 117, 118, 135 are used which otherwise could have been separately used. The cell thus created is connected between 27, 28, 116. The switch 119 is connected between 141 and 116 in parallel with diode 120 and capacitor 135 with its cathode at 141. Similarly the switch 122 is connected between 142 and 116 in parallel with diode 121 and capacitor 135 having its cathode at 141. The primary 109 with a leakage inductor 110 is connected between 116 and the series connected capacitor junction 114. A control circuit 124 controls the gate voltage to the switches 119 and 122. The switching frequency of this inverter is kept at 1.25 times the resonant frequency of 117 or 118 and 135.

The inverter is operated between continuous current mode and discontinuous current mode. At this boundary following formulae holds good:

$$L_E=[((L_{117})(L_{118}))/(L_{117}+L_{118})];\ K=(2L_EF_S/R_L);\ \text{and}$$

$$M=[(2)/[1+[1+(4*K/D^2)]^{1/2}]$$

at the boundary M=1−K.

The voltage ripple, i.e. rectified sine wavelike waveform, across capacitor 135, is given by:

$$RV135=K*M^2/\ [(F_S)(R_L)(C_{135})]\ \text{for 50\% duty ratio M=K=0.5,}$$

where:

$F_S$=switching frequency of the inverter $R_L$=equivalent load reflected at the primary of the transformer 115

M=Mutual inductance of inductors 117 and 118.

Secondary 111 of the transformer 115 is connected to the terminals 29 and 30. A ballast filter is connected at the terminals 29 and 30. This filter may have either a capacitor in series with the lamp or the inductor in series with the lamp. The ballast filter consists of series connections of inductor 113 and capacitor 112. The output of the ballast filter is available at the terminal 31 and 32. These terminals are connected to the lamp 16. The resonant frequency of ballast filter is kept at 1.25 times that of the switching frequencies to provide a sufficient firing voltage to the lamp.

Obviously, numerous modifications and variations of the present invention are possible in light of the above teachings. It is therefore to be understood that within the scope of the appended claims, the invention may be practiced otherwise than as specifically described herein.

What is claimed as new is:

1. An electronic ballast for operating at least one HID lamp, having a high power factor, low "on" losses, low THD, and high overall efficiency with a provision for a plurality of lamp connections for the lighting industry in general comprising:

a power factor controller to control a supplied DC voltage and to control the power factor of an input voltage;

a feedback means for regulating the DC voltage depending upon the light output from at least one of the HID lamps;

a controlling means for controlling a negative voltage available from the power factor controller;

a resonant inverter connected to the output of the power factor controller to generate high frequency current;

a controller to control the switching frequency of the resonant inverter and to provide proper gate voltages to resonant inverter switches; and a ballast filter to boost the voltage given to the at least one lamp by a quality factor to help firing of the at least one lamp without additional circuitry;

wherein the electronic ballast has a negative DC output less than or equal to a peak input voltage.

2. The electronic ballast of claim 1, wherein the power factor controller comprises:

a series connection of a first inductor, a first capacitor, and a second inductor connected across a first bridge rectifier form where it receives rectified power from an AC power supply;

a switch means connected to a second terminal of the first inductor and a first terminal of the first capacitor, where a second terminal of the switch is connected to a current sensing means which further is connected to a first terminal of a filter capacitor circuit; and a diode with its anode connected to a second terminal of the first capacitor and a first terminal of the second inductor and its cathode connected to the first terminal of the filter capacitor circuit; wherein, said filter capacitor circuit has a first terminal connected to the junction of the current sensing means and the diode's cathode and a second terminal connected to the junction of the second inductor's second terminal and a second terminal of the first bridge rectifier.

3. The electronic ballast of claim 1, wherein the feedback means comprises a light dependent resistor; an active potential divider consisting of operational amplifiers; resistor networks and custom power factor controller integrated circuits; and an oscillator to operate the power factor controller at no load during zero crossing of an input current.

4. The electronic ballast of claim 3; where the oscillator of the feedback means provides a start up function for a negative voltage available from the power factor controller.

5. The electronic ballast of claim 1, wherein the resonant inverter comprises:

a pair of supply capacitors connected in series circuit and in parallel with the output terminals of said power factor controller;

a pair of inductors each having two terminals, a first terminal of a first inductor and a second terminal of a second inductor being respectively connected to each one of said power factor controller output terminals;

an energy transfer capacitor having two terminals, one of said energy transfer capacitor terminals connected to a second terminal of the first inductor of said inductor pair, and a second terminal of the energy transfer capacitor connected to a first terminal of the second inductor of the inductor pair;

a pair of switching circuits connected in parallel between the second terminal of the first inductor and the first terminal of the second inductor, each of the switching circuits comprising a switch and a diode connected in series;

said switching circuits connected such that a junction between the switch and cathode of the diode of one of the switching circuits is connected as a second junction between the switch and anode of the diode of the other switching circuit; the junctions of the pair of switching circuits being connected to a first terminal of a primary winding of a transformer having sufficient leakage inductance; and the other terminal of the primary winding of said transformer being connected at a junction between said pair of supply capacitors.

6. The electronic ballast of claim 5, wherein only load current flows through the switching circuits.

7. The electronic ballast of claim 5, wherein the energy transfer capacitor is connected before the switching circuits, thus reducing the burden of extra current through the switching circuits.

8. The electronic ballast of claim 5, wherein the resonant frequency of a pair of inductors and the energy transfer capacitor is kept at 0.8 times the switching frequency.

9. The electronic ballast of claim 5, wherein the transformer of said resonant inverter further comprises a secondary winding connected in parallel circuit with a ballast filter, the ballast filter comprising a series circuit of a ballast inductor and a ballast capacitor.

10. The electronic ballast of claim 9, wherein the transformer further comprises multiple ballast filters connected in parallel with the secondary winding, each ballast filter consisting of a series connection of said ballast inductor and said ballast capacitor.

11. The electronic ballast of claim 9, wherein a lamp is preferably connected across the ballast inductor to minimize the acoustic arc resonance.

12. The electronic ballast of claim 10, wherein a lamp is preferably connected across the ballast inductor to minimize the acoustic arc resonance.

13. The electronic ballast of claim 5, wherein the resonant inverter farther comprises trigger control circuit means for providing drive signals to gates of the switches of said switching circuits.

14. The electronic ballast of claim 8, wherein the resonant inverter further comprises trigger control circuit means for providing drive signals to gates of the switches of said switching circuit and for providing the switching frequency.

15. A lighting inverter comprising:

a series connection of a first inductor, an energy transfer capacitor, and a second inductor;

a first switching circuit connected in parallel with the energy transfer capacitor, between the first and second inductors; and a second switching circuit connected in parallel with the energy transfer capacitor and the first switching circuit, between the first and second inductors;

wherein the energy transfer capacitor receives current before the first and second switching circuits, thus reducing extra current through the first and second switching circuits.

16. An electronic ballast for operating at least one HID lamp, having a high power factor, low "on" losses, low THD, and high overall efficiency with a provision for a plurality of lamp connections for the lighting industry in general, comprising:

a power factor controller to control a supplied DC voltage and to control the power factor of an input voltage;

a feedback means for regulating the DC voltage depending upon the light output from at least one of the HID lamps;

a controlling means for controlling a negative voltage available from the power factor controller;

a resonant inverter connected to the output of the power factor controller to generate high frequency current;

a controller to control the switching frequency of the resonant inverter and to provide proper gate voltages to resonant inverter switches; and a ballast filter to boost the voltage given to the at least one lamp by a quality factor to help firing of the at least one lamp without additional circuitry;

wherein the electronic ballast has a negative DC output less than or equal to a peak input voltage.

* * * * *